US010166569B1

(12) United States Patent
Ries et al.

(10) Patent No.: US 10,166,569 B1
(45) Date of Patent: Jan. 1, 2019

(54) PAINTING SYSTEM

(71) Applicant: Susan Ries, Burnsville, MN (US)

(72) Inventors: Susan Ries, Burnsville, MN (US); Jason Todd Murar, Macomb, MI (US)

( * ) Notice: Subject to any disclaimer, the term of this patent is extended or adjusted under 35 U.S.C. 154(b) by 447 days.

(21) Appl. No.: 14/815,859

(22) Filed: Jul. 31, 2015

Related U.S. Application Data

(63) Continuation-in-part of application No. 13/645,342, filed on Oct. 4, 2012, now Pat. No. 9,180,479, which is a continuation-in-part of application No. 12/631,401, filed on Dec. 4, 2009, now abandoned.

(60) Provisional application No. 62/031,180, filed on Jul. 31, 2014, provisional application No. 61/120,508, filed on Dec. 8, 2008.

(51) Int. Cl.

| | |
|---|---|
| ***B05C 1/00*** | (2006.01) |
| ***B05C 1/06*** | (2006.01) |
| ***B05C 17/00*** | (2006.01) |
| ***B05C 17/10*** | (2006.01) |

(52) U.S. Cl.
CPC ..... *B05C 17/00* (2013.01); *B05C 1/00* (2013.01); *B05C 1/06* (2013.01); *B05C 17/10* (2013.01)

(58) Field of Classification Search
CPC .. B05C 1/00; B05C 1/06; B05C 17/00; B05C 17/10
See application file for complete search history.

(56) References Cited

U.S. PATENT DOCUMENTS

| | | | | |
|---|---|---|---|---|
| 3,366,988 A * | 2/1968 | Ginter | A46B 5/00 | 15/244.1 |
| 3,389,418 A * | 6/1968 | Sencabaugh | A61H 7/003 | 15/244.1 |
| 4,856,136 A * | 8/1989 | Janssen | A46B 3/02 | 15/210.1 |
| 5,774,925 A * | 7/1998 | Pryor, III | A46B 9/005 | 15/244.1 |
| 7,076,826 B2 * | 7/2006 | Hochanadel | B05C 17/00 | 15/143.1 |
| 2006/0075592 A1 * | 4/2006 | Sommers | A45D 34/04 | 15/244.1 |
| 2007/0157408 A1 * | 7/2007 | Bargiel | A45D 34/04 | 15/209.1 |

* cited by examiner

*Primary Examiner* — Randall Chin
(74) *Attorney, Agent, or Firm* — Moss & Barnett; Michael A. Bondi

(57) ABSTRACT

A painting system having a paint applicator holder, a paint applicator and a paint tray. The paint applicator holder has a handle portion and an applicator portion that extends from the handle portion. The paint applicator has an applicator base and an applicator pad. The applicator base is capable of engaging the applicator portion. The applicator pad is capable of receiving paint. The paint tray has a lower surface and a side wall extending therefrom to define a recess that is adapted to receive paint. The paint tray further also has at least one ridge extending from the lower surface into the recess to longitudinally and latitudinally support the paint applicator above the lower surface.

18 Claims, 6 Drawing Sheets

PAINTING SYSTEM

REFERENCE TO RELATED APPLICATION

This application claims priority to U.S. Application No. 62/031,180, which was filed on Jul. 31, 2014. The present application is a continuation-in-part of U.S. application Ser. No. 13/645,342, which was filed on Oct. 4, 2012, now U.S. Pat. No. 9,180,479, which is a continuation-in-part of U.S. application Ser. No. 12/631,401, which was filed on Dec. 4, 2009, now abandoned, which claimed priority to U.S. Provisional Application No. 61/120,508, which was filed Dec. 8, 2008, the contents of which are expressly incorporated by reference herein.

FIELD OF THE INVENTION

The present invention generally relates to paint application devices. More particularly, the invention relates to a painting apparatus and method of use in connection with painting within narrow spaces.

BACKGROUND OF THE INVENTION

In certain situations it is desirable to mount objects close to surfaces to minimize the portion of the location in which the object is located that is occupied by the object. An example of one such object is a toilet. It is possible to mount the toilet close to a wall because it is generally not necessary to access the portion of the wall that is behind the toilet.

One of the primary times that it is necessary to access the space behind the toilet is when decorating. For example, it is generally desirable to paint the space behind the toilet when painting other portions of the wall that are not behind the toilet.

While conventional painting implements such as rollers and paint brushes may be used on the other portions of the wall that are not behind the toilet, the toilet is typically located sufficiently close to the wall such that it is not possible to access all of the space that is behind the toilet with a conventional roller or paint brush.

To overcome this limitation, it is common to disconnect at least a portion of the toilet to facilitate painting behind the toilet. A problem with disconnecting a portion of the toilet is that it may be necessary to have the portion of the toilet disconnected by a plumber because the toilet contains water and drain lines. Any water and/or waste that inadvertently escapes from the toilet may not only cause damage to the areas that surround the toilet, but also could present a health risk.

A need exists for improvement in paint application devices. This need, and other needs, are addressed by one or more aspects of the present invention.

SUMMARY OF THE INVENTION

An embodiment of the invention is directed to a painting system that includes a paint applicator holder, a paint applicator and a paint tray. The paint applicator holder has a handle portion and an applicator portion that extends from the handle portion. The paint applicator includes an applicator base and an applicator pad. The applicator base is capable of engaging the applicator portion. The applicator pad is capable of receiving paint. The paint tray has a lower surface and a side wall extending therefrom to define a recess that is adapted to receive paint. The paint tray further includes at least one ridge extending from the lower surface into the recess to longitudinally and latitudinally support the paint applicator above the lower surface.

Another embodiment of the invention is directed to a painting system that includes a paint applicator and a paint applicator holder. The paint applicator has an elongated configuration with a length that is substantially greater than a width and a width that is substantially greater than a height. The paint applicator has a generally planar shape. The paint applicator holder extends from an end of the paint applicator that corresponds to the width of the paint applicator.

Another embodiment of the invention is directed to a painting system that includes a handle portion, an applicator portion and a paint applicator. The handle portion has a distal end. The applicator portion extends from the distal end of the handle portion. The applicator portion has a convex shape. The paint applicator is attachable to the applicator portion. The paint applicator has an applicator pad that is capable of receiving paint. The paint applicator has a generally planar shape.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

An embodiment of the invention is directed to a painting system 10 that is particularly adapted for use in applying a coating such as paint to a first surface that is relatively close to a second surface. Because of the proximity of the first surface to the second surface, it is difficult or not possible to use a traditional paint brush having a handle and a plurality of bristles extending therefrom or a conventional paint roller having a handle and a cylindrical paint applicator rotatably mounted thereto.

Figure 16:
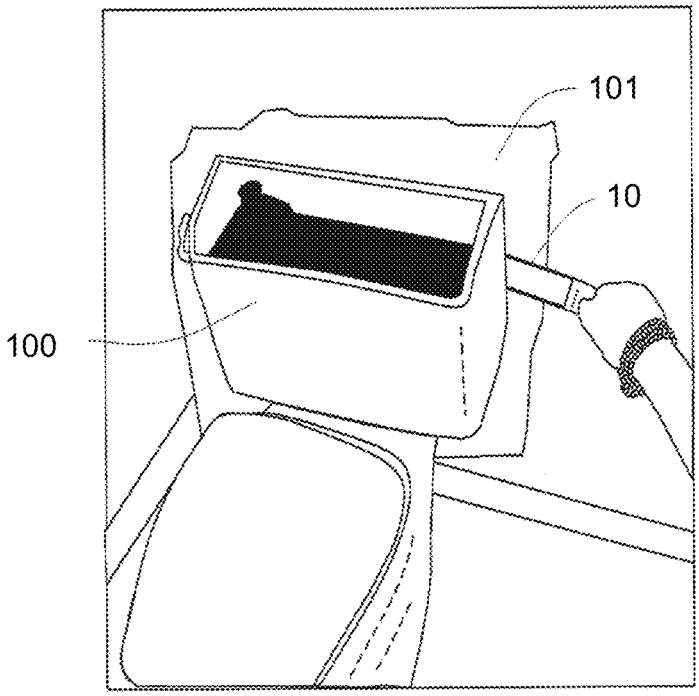
FIG. 16 is a front view of the use of the painting system to apply paint to a wall behind a toilet bowl.

The painting system 10 facilitates applying paint to a wall surface 101 where an object 100 is relatively close to the wall surface 101, as illustrated in FIG. 16, such that it is not possible to paint the wall surface 101 using a conventional paint brush or paint roller. In this regard the painting system 10 includes a paint applicator 12 with an elongated configuration with a length that is substantially greater than a width and a width that is substantially greater than a height. The paint applicator 12 also has a generally planar shape to facilitate substantially all of the paint applicator 12 being in contact with the wall surface 101 as a given time.

The painting system 10 also includes a paint applicator holder 14 that extends from an end of the paint applicator 12 that corresponds to the width of the paint applicator 12. Using such a configuration, the paint applicator 12 and the paint applicator holder 14 are generally along a plane even though the paint applicator 12 may be oriented at an angle with respect to the portion of the paint applicator holder 14 that is grasped by the person using the painting system 10. This configuration maximizes a distance at which the person using the painting system 10 can paint the wall surface 101 behind the object 100.

Additionally, the configuration of the painting system 10 provides a combined length of the applicator portion 22 and the intermediate portion 24 of at least 10 inches. Since a water tank used on a conventional toilet is typically no larger than 20 inches, the painting system 10 permits painting of the entire surface behind the toilet without the person's hand needing to fit behind the toilet bowl and without the time and expense of removing the water tank from the toilet to accomplish such task.

In certain embodiments, the painting system 10 generally includes a paint applicator 12, a paint applicator holder 14, a paint tray 16 and an outer cover 18 as illustrated in the figures. FIGS. 1-5 illustrate the painting system 10 from various directions and in various stages of assembly.

Figure 6:
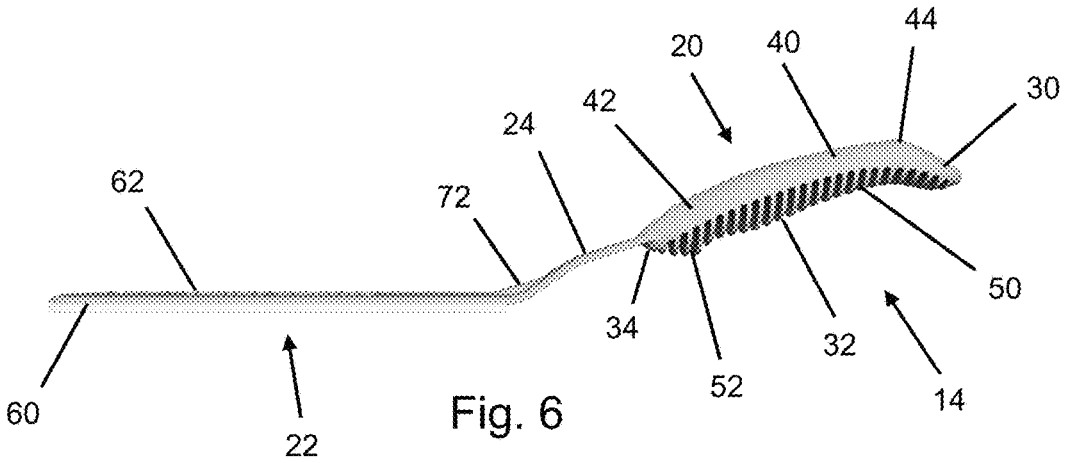
FIG. 6 is a side view of a paint applicator holder of the painting system.

The paint applicator holder 14 includes a handle portion 20, an applicator portion 22 and an intermediate portion 24, as illustrated in FIG. 6. The handle portion 20 includes several features that enhance the ability to hold onto the handle portion 20 if part of the handle portion 20 is covered with paint, which can reduce the ability to grasp the handle portion 20.

The handle portion 20 may generally be defined as including a proximal section 30, an intermediate section 32 and a distal section 34. In certain embodiments, the proximal section 30, the intermediate section 32 and the distal section 34 may be integrally formed.

The proximal section 30 may be oriented at an angle with respect to the intermediate section 32. Orienting the proximal section 30 at an angle with respect to the intermediate section 32 reduces the potential of a user's hand slipping off the end of the paint applicator 12 while using the painting system 10.

Orienting the proximal section 30 at an angle with respect to the intermediate section 32 also enables the user to sense the position of the user's hand on the handle portion 20 without the user having to view the position of the hand on the handle portion 20.

In certain embodiments, when viewed from a lower surface of the handle portion 20, the proximal section 30 is oriented at an obtuse angle with respect to the intermediate section 32. In other embodiments, an angle between the proximal section 30 and the intermediate section 32 is between about 145 degrees and about 170 degrees.

The proximal section 30 may have a maximum width and/or a maximum height that is larger than a maximum width and/or a maximum height of the intermediate section 32. Forming the proximal section 30 with the maximum width and/or the maximum height that is larger than the maximum width and/or the maximum height of the intermediate section 32 reduces the potential of the user's hand slipping off of the end of the paint applicator 12 because even if the user's hand is held slightly larger than the intermediate section 32, the user's hand will encounter the wider and/or higher proximal section 30.

Forming the proximal section 30 with the maximum width and/or the maximum height that is larger than the maximum width and/or the maximum height of the intermediate section 32 also enables the user to sense the position of the user's hand on the handle portion 20 without the user having to view the position of the hand on the handle portion 20.

In certain embodiments, the maximum width and/or the maximum height of the proximal section 30 is more than 5 percent larger than the maximum width and/or the maximum height of the intermediate section 32. In other embodiments, the maximum width and/or the maximum height of the proximal section 30 is between about 10 and 30 percent larger than the maximum width and/or the maximum height of the intermediate section 32.

An upper surface 40 and at least a portion of side surfaces 42 of the proximal section 30 may be curved to generally conform to a shape of a portion of a user's hand who is holding the paint applicator 12.

At least part of the upper surface 40 and the side surfaces 42 may be substantially smooth. Alternatively, at least part of the upper surface 40 and the side surfaces 42 may be textured to enhance the ability for the user to grasp the handle portion 20.

The proximal section 30 may encompass up to about 30 percent of a length of the handle portion 20. In certain embodiments, the proximal section 30 encompasses between about 10 percent and about 25 percent of the length of the handle portion 20.

At least one of the top surface and the bottom surface of the handle portion 20 may include a non-smooth transition 44 between the proximal section 30 and the intermediate section 32. In certain embodiment, the non-smooth transition 44 is a ridge on the upper surface.

The non-smooth transition enhances the ability of the user to sense the position of the user's hand on the handle portion 20 without the user having to view the position of the hand on the handle portion 20.

The intermediate section 32 may encompass up to about 80 percent of a length of the handle portion 20. In certain embodiments, the intermediate section 32 encompasses between about 40 percent and about 80 percent of the length of the handle portion 20.

The proximal section 30 may have a depression 46 formed in an upper surface thereof. The depression 46 is adapted to receive a portion of a tip of a user's thumb. The depression 46 enhances the ability of the user to sense the position of the user's hand on the handle portion 20 without the user having to view the position of the hand on the handle portion 20.

The depression 46 may have a width and a length that are slightly larger than a width and a length of the tip of the user's thumb. The width and the length of the depression 46 should not be significantly larger than the width and the length of the tip of the user's thumb because such a configuration would impair the ability of the user to utilize the position of the tip of the user's thumb as indicating the position of the user's hand on the handle portion 20. In certain embodiments, the width and the length of the depression 46 may each be between about ½ of an inch and 1 inch.

The depression 46 should have a depth that is sufficiently large such that the user can readily feel when the tip of the user's thumb is positioned in the depression 46 without the user having the visually see that the tip of the user's thumb is positioned in the depression 46. The depression 46 thereby enables the person using the painting system 10 to avoid positioning his/her hands in a location on the painting system 10 that is likely to come into contact with the toilet 100 when the painting system 10 is extended behind the toilet 100 to paint all of the wall surface 101.

However, the depth of the depression 46 should not be too great such that the user perceives the depression as being indicative of the end of the handle portion 20. Additionally, if the depression 46 is too deep, the user may experience discomfort caused by the user's thumb contacting the lip surrounding the depression 46.

In certain embodiments, the depression 46 has a depth of up to about ½ of an inch. In other embodiments, the depression 46 has a depth that is between about ⅛ of an inch and about ¼ of an inch.

A plurality of channels 50 is formed in a lower side of the handle portion 20. The channels 50 each have a depth that is between about 10 percent and about 50 percent of the height of the handle portion 20. In certain embodiments, the channels 50 may each have a depth that is approximately the same. In other embodiments, the channels 50 at different locations on the handle portion 20 may have different depths.

The plurality of channels 50 may be positioned in a spaced-apart relationship such that a spacing between each of the channels 50 is substantially equal. A width of the channels 50 may be approximately the same as a width of the ribs 52 that are positioned between each of the channels 50.

The channels 50 may be oriented at an angle with respect to an upper surface of the handle portion 20. In certain embodiments, the angle is between about 45 degrees and about 135 degrees. In other embodiments, the angle is between about 60 degrees and about 120 degrees.

In still other embodiments, the channels 50 are not oriented substantially transverse to the upper surface of the handle portion 20. By orienting the channels 50 at an angle with respect to the upper surface of the handle portion 20 that is not transverse to the upper surface, the ribs 52 are more likely to deflect when the handle portion 20 is grasped by the user's hand.

The rib 52 should be sufficiently wide so that the person using the paint applicator 12 does not experience discomfort when contacting the edges of the ribs 52. In certain embodiments, the edges of the ribs 52 may be slightly curved.

Forming the channels 50 in the preceding manner provides the handle portion 20 with a lower surface that may be grasped by the user. However, the channels 50 are adapted to receive paint that is on the user's hand.

The channels 50 thereby can cause the paint to be scraped off of the user's hand as the person's hand moves with respect to the handle portion 20. Alternatively or additionally, the channels 50 receiving the paint enhance the ability of the user to grasp the handle portion 20.

The ribs 52 may be formed with a sufficiently thin thickness such that the ribs 52 are deflectable by manual pressure from the user's fingers when the user is holding the handle portion 20. The deflectable ribs 52 thereby enhance the comfort to the user such that the handle portion 20 may be fabricated from a single type of material that provides a rigid upper surface and a deflectable lower surface.

Yet another advantage of forming the channels 50 in the handle portion 20 is that the weight of the paint applicator 12 is reduced when compared to the handle portion 20 that is formed from a solid piece of material. This reduced weight reduces fatigue to the user caused by holding a heavier painting apparatus that does not include the channels 50.

Furthermore, the channels 50 reduce the cost associated with manufacturing the paint applicator 12 compared to a design that does not include the channels 50 because less material is used to fabricate the handle portion 20 of the paint applicator 12 that includes the channels 50.

The distal section 34 may encompass up to about 30 percent of a length of the handle portion 20. In certain embodiments, the distal section 34 encompasses between about 10 percent and about 25 percent of the length of the handle portion 20.

The applicator portion 22 has a first surface 60 and a second surface 62 that are oriented opposite each other. In certain configurations, the first surface 60 is substantially flat and is adapted to receive the paint applicator 12. Depending on the intended use of the painting apparatus 10, the applicator portion 22 may be formed of varying lengths.

One factor that may affect the length of the applicator portion 22 is the size of the object behind which the person using the painting apparatus 10 desires to paint. In certain embodiments, the applicator portion 22 has a length of between about 2 inches and about 36 inches. In other embodiments, the applicator portion 22 has a length of between about 12 inches and about 18 inches.

Depending on the material from which the applicator portion 22 is formed, it may be necessary to strengthen the applicator portion 22 to ensure that an end of the applicator portion 22 that is opposite the handle portion 20 is sufficiently rigid to cause the paint to be applied to the surface.

An example of one such strengthening device is a rib 72 that extends along at least a portion of a length of the applicator portion 22. The rib 72 may span an intersection between the applicator portion 22 and the intermediate portion 24.

The applicator portion 22 may be formed with a width that depends on factors such as the size of the object behind which it is desired to paint and the volume of paint that is desired to be held with the applicator material 12.

The applicator portion 22 may include measuring indicia (not shown) on a surface thereof. In certain embodiments, the measuring indicia may be provided on the second surface 62. The measuring indicia may be positioned proximate to at least one of the edges of the applicator portion 22. In certain embodiments, the measuring indicia extend substantially between a proximal end and a distal end of the applicator portion 22.

In certain embodiments, the measuring indicia may be provided in inches. In addition to marks spaced one inch apart, the measuring indicia may include a plurality of intermediate marks. The intermediate marks may be placed at a spacing of about ¼ of an inch. In addition to the marks, the measuring indicia may also include numbers to facilitate the person using the painting apparatus 10 to readily determine the distance.

Depending on the material from which the applicator portion 22 is formed, the measuring indicia may be integrally formed with the other parts of the applicator portion 22. In other embodiments, the measuring indicia may be applied to the applicator portion 22. Examples of techniques that may be used to apply the measuring indicia are painting or printing.

An advantage of using the indicia that are raised above a surface of the applicator portion 22 is that it may remain possible for the person using the painting apparatus 10 to view the measuring indicia even after paint accumulates on the part of the applicator portion 22 where the measuring indicia is located.

The measuring indicia may be used to determine how far the person has painted in from an edge of the object that is located near to the wall. The measuring indicia thereby enable the person to minimize the potential of not painting far enough behind an object from a first side. When this happens, the person would not realize that he or she has not painted far enough behind the object until the person had painted one of the other sides. In this situation, the person would have to go back to the first side for additional painting.

Such a situation is highly undesirable because it would not only increase the time associated with the painting project but could also present a significant issue that negatively impacts the outcome of the painting project if the paint along the first side had already begun to dry when the person comes back over to the first side for the additional painting The larger the width of the applicator material 12, the more paint that may be held in the applicator material 12, which thereby reduces the frequency at which the applicator must be refilled with paint. In certain embodiments, the width of the applicator material 12 is up to about 6 inches. In other embodiments, the width of the applicator material 12 is between about ½ of an inch and 2 inches.

In certain embodiments, the applicator material 12 has a surface covering that is consistent over the entire surface thereof. In other embodiments, the applicator material 12 may have at least two applicator regions that are fabricated from different materials.

The applicator material 12 may be attached to the applicator portion 22 using a variety of techniques. In certain embodiments, the applicator material 12 is permanently attached to the applicator portion 22. Using such a configuration, the painting apparatus 10 may be discarded after use.

In other embodiments, the applicator material 12 may be removably attached to the applicator portion 22. An example of one technique that may be used to removably attach the applicator material 12 to the applicator portion 22 is an adhesive or a hook and loop fastener such as is available under the designation VELCRO.

Alternatively or additionally, a portion of the applicator material 12 may extend over at least a portion of the applicator portion 22 such that sliding of the applicator material 12 with respect to the applicator portion 22 facilitates attachment or detachment of the applicator material 12 to the applicator portion 22. In such a configuration, a lock mechanism may be provided to retain the applicator material 12 in a desired location with respect to the applicator portion 22.

The intermediate portion 24 may offset the handle portion 20 from the applicator portion 22 such that when the applicator portion 22 is positioned along a surface for applying paint to the surface, the handle portion 20 is located above the surface such that the user's hand does not contact the surface.

In certain embodiments, the offset between the handle portion 20 and the applicator portion 22 is up to about 6 inches. In other embodiments, the offset between the handle portion 20 and the applicator portion 22 is between about 1 inch and about 3 inches.

The intermediate portion 24 may be oriented at an angle with respect to the applicator portion 22. In certain embodiments, the angle may be between about 20 degrees and about 90 degrees.

The handle portion 20, the applicator portion 22 and the intermediate portion 24 may be oriented in different configurations. Examples of the alternative configurations provide the painting apparatus 10 with a C-shape or an L-shape.

The intermediate portion 24 may be integrally formed with at least one of the handle portion 20 and the applicator portion 22. In other embodiments, the intermediate portion 24 may be fabricated separately from at least one of the handle portion 20 and the applicator portion 22.

The intermediate portion 24 should exhibit sufficient rigidity so that the handle portion 20 may be used to apply pressure to the applicator portion 22 without the intermediate portion 24 experiencing deformation.

Because of the nature of the materials from which the paint applicator holder 14 is formed, it may not be possible to prevent deflection of the applicator portion 22 and/or the intermediate portion 24 while the painting system 10 is used to apply paint to the wall surface 101. However, the paint applicator holder 14 should substantially resist deflection or at least substantially control the deflection so that the paint applicator 12 causes substantially uniform application of paint to the wall surface.

Figure 7:
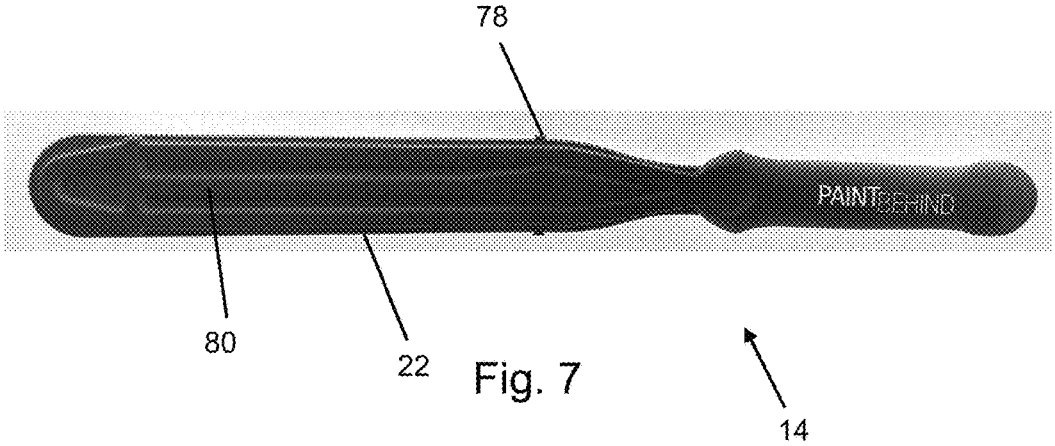
FIG. 7 is a top view of the paint applicator holder.
Figure 8:
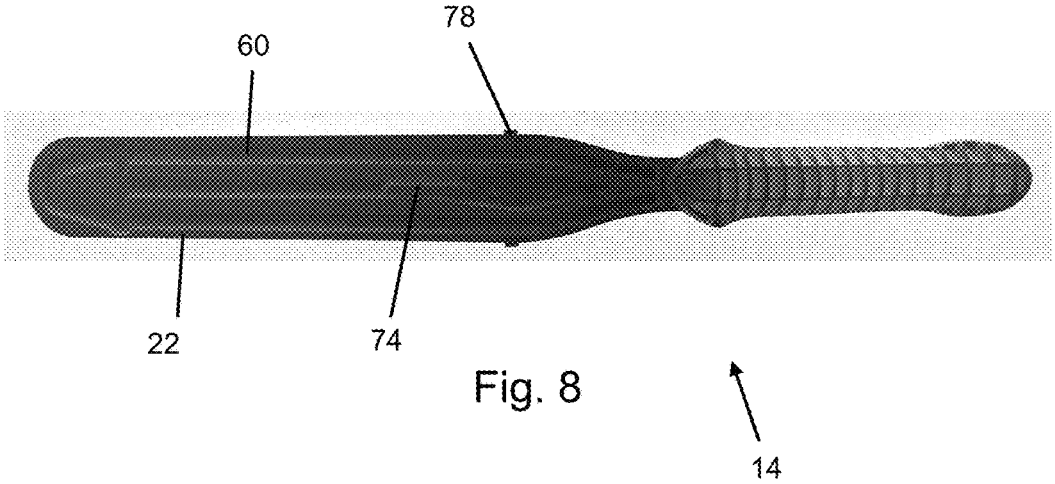
FIG. 8 is a bottom view of the paint applicator holder.
Figure 9:
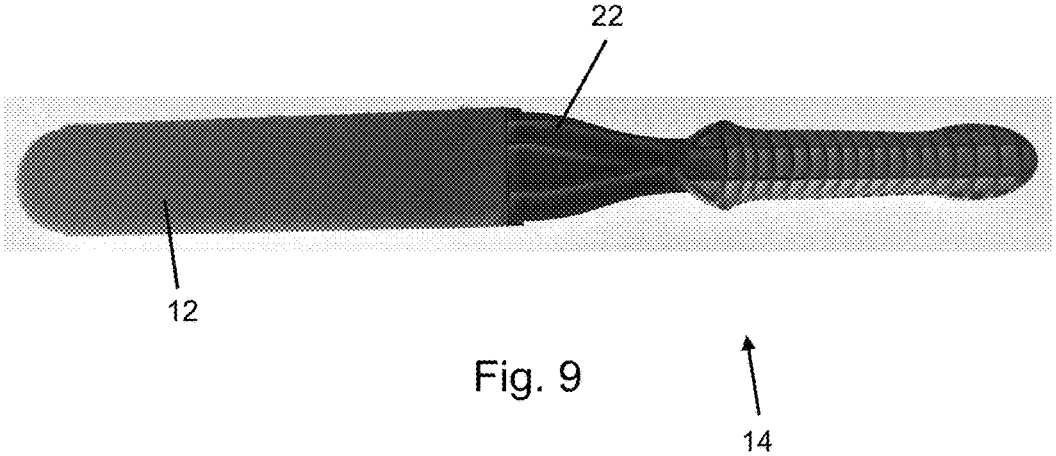
FIG. 9 is a bottom view of the paint applicator holder with a paint applicator attached thereto.

The following description of the features of the components of the paint applicator holder 14 is provided with respect to the structure illustrated in FIGS. 7-9. The first surface 60 of the applicator portion 22 may have a generally flat configuration to provide support to the paint applicator 12. In certain embodiments, the first surface 60 is substantially flat proximate edges thereof.

At least one engagement structure 74 extends from the first surface 60. The at least one engagement structure 74 seats in a recess 76 in a lower surface of the paint applicator 12 to thereby retain the paint applicator 12 in a generally stationary position with respect to the applicator portion 22 as the painting system 10 is being used.

In certain embodiments, the engagement structure 74 may have a generally linear shape that is oriented to extend generally parallel to a length of the applicator portion 22. While the engagement structure 74 may be positioned at various locations on the applicator portion 22, in certain embodiments, the engagement structure 74 is proximate the proximal end of the applicator portion 22.

The engagement structure 74 has a height that is sufficiently high to minimize the paint applicator 12 inadvertently moving with respect to the applicator portion 22. However, the engagement structure 74 permits the paint applicator 12 to be moved with respect to the applicator portion 22 when a larger than threshold force is applied to at least one of the applicator portion 22 and the paint applicator 12.

At least one of the paint applicator 12 and the applicator portion 22 include a stop mechanism 78 to prevent over-insertion of paint applicator 12 onto the applicator portion 22. In certain embodiments, the stop mechanism 78 is a tab that extends from at least one side of the applicator portion 22. The stop mechanism 78 may have a height that is similar to the thickness of the paint applicator 12 so that when the paint applicator 12 is engaged on the applicator portion 22, the stop mechanism 78 does not extend beyond the outer surface of the paint applicator 12.

The applicator portion 22 may include at least one reinforcing ridge 80 that extends from the second surface 62. While not illustrated, it is also possible for the at least one reinforcing ridge 80 to extend from the first surface 60. The at least one reinforcing ridge 80 may be generally aligned to extend along a length of the applicator portion 22. In certain embodiments, there are three reinforcing ridges 80 that are oriented in a generally parallel relationship.

The reinforcing ridges 80 provide additional strength to the applicator portion 22 to reduce deflection of the applicator portion 22 as the painting system 10 is used to apply paint to the wall surface 101. It is desired for a force applied by the paint applicator 12 to be substantially equal along a length thereof. This configuration facilitates applying a generally equal amount of paint to the wall surface 101 along the length of the paint applicator 12.

The at least one reinforcing ridge 80 may span the intersection of the intermediate portion 24 and the applicator portion 22 to limit deflection of the applicator portion 22 with respect to the intermediate portion 24 during the use of the painting system 10. At least one of the reinforcing ridges 80 may have a different shape proximate the intersection of the intermediate portion 24 and the applicator portion 22.

In one such configuration, the at least one reinforcing ridge has an increased width section. Such a configuration is believed to further reduce deflection of the applicator portion 22 with respect to the intermediate portion 24 during the use of the painting system 10. Another benefit of the increased width section is that the wider reinforcing ridge 80 provides a wider region on the first surface 60 to facilitate the person urging the paint applicator 12 to begin movement off of the applicator portion 22. Such force needs to be sufficiently large to overcome the resistance caused by the engagement structure 74 seating in the recess 76.

Proximate the distal end of the applicator portion 22, the reinforcing ridges 80 may interconnect to further reduce deflection of the applicator portion 22 during the use of the painting system 10. Such interconnection may include the reinforcing ridge 80 extending proximate the distal end of the applicator portion 22 in a shape that is similar to the shape of the distal end of the applicator portion 22.

The interconnection of the reinforcing ridges 80 may also include orienting a portion the reinforcing ridge 80 generally perpendicular to the other portions of the reinforcing ridges 80. This portion of the reinforcing ridge 80 may be proximate the distal end of the applicator portion 22.

The applicator portion 22 may be formed with a convex configuration so that an intermediate portion of the applicator portion 22 is elevated with respect to proximal and distal ends of the applicator portion 22. The convex configuration should be large enough to allow sufficient pressure to be applied to the distal end of the applicator portion 22 while not causing too much pressure to be applied to the proximal end of the applicator portion 22.

The convex configuration causes an increased amount of force to be applied to the distal end of the paint applicator 12. This configuration enhances the ability to apply a generally equal amount of paint to the wall surface 101 along the length of the paint applicator 12.

Figure 10:
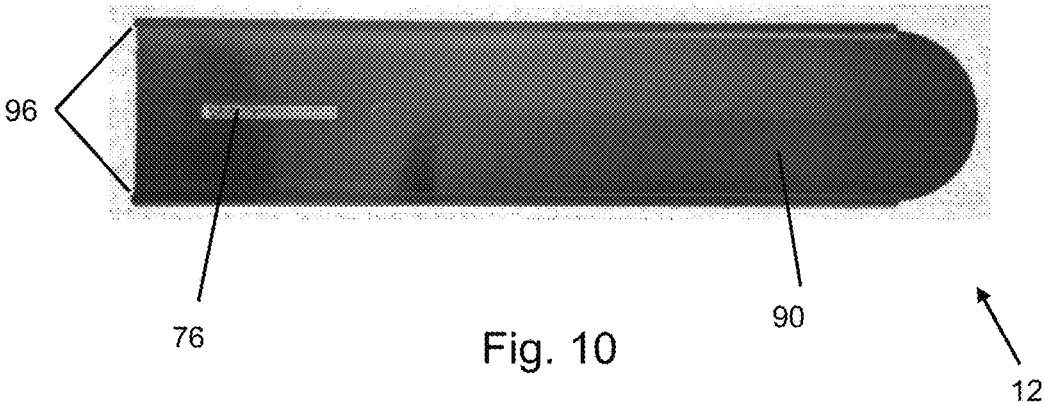
FIG. 10 is a top view of the paint applicator.
Figure 11:
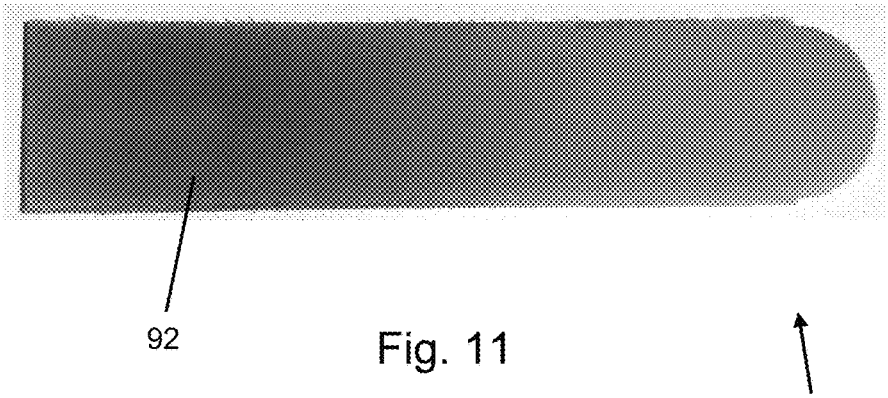
FIG. 11 is a bottom view of the paint applicator.
Figure 12:
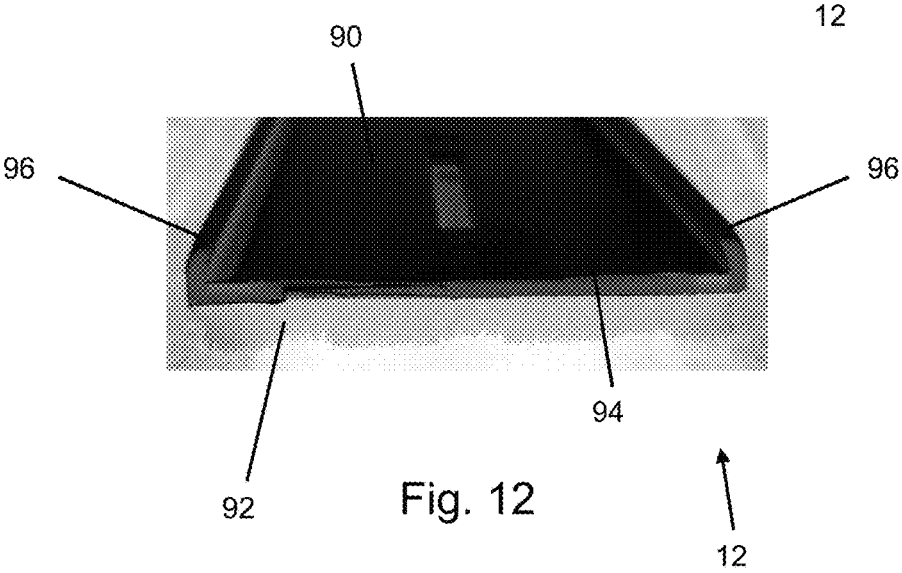
FIG. 12 is a perspective end view of the paint applicator.

The paint applicator 12, which is illustrated in FIGS. 10-12, may have a two part configuration that includes an applicator base 90 to which an applicator pad 92 is attached. The applicator base 90 facilitates retaining the paint applicator 12 in engagement with the applicator portion 22. In certain embodiments, the applicator base 90 has a central region 94 from which arm regions 96 extend. The arm regions 96 may be positioned on opposite sides of the central region 94. The arm regions 96 are directed towards each other to define a recess therebetween that is adapted to receive at least a portion of the applicator portion 22.

The applicator pad 92 may be formed with a shape that is similar to the shape of the applicator portion 22. While the distal end of the applicator pad 92 is illustrated as being circular, it is possible for the distal end to have alternative shapes such as being pointed to enhance the ability to apply paint in a corner.

The applicator pad 92 may be fabricated from a variety of materials that are capable of absorbing paint such as when the applicator pad 92 is immersed in the paint tray 16. Thereafter, the material enables the paint to the applied to the wall surface 101. Examples of suitable materials for use in fabricate the applicator pad 92 are fibers and foam.

Figure 13:
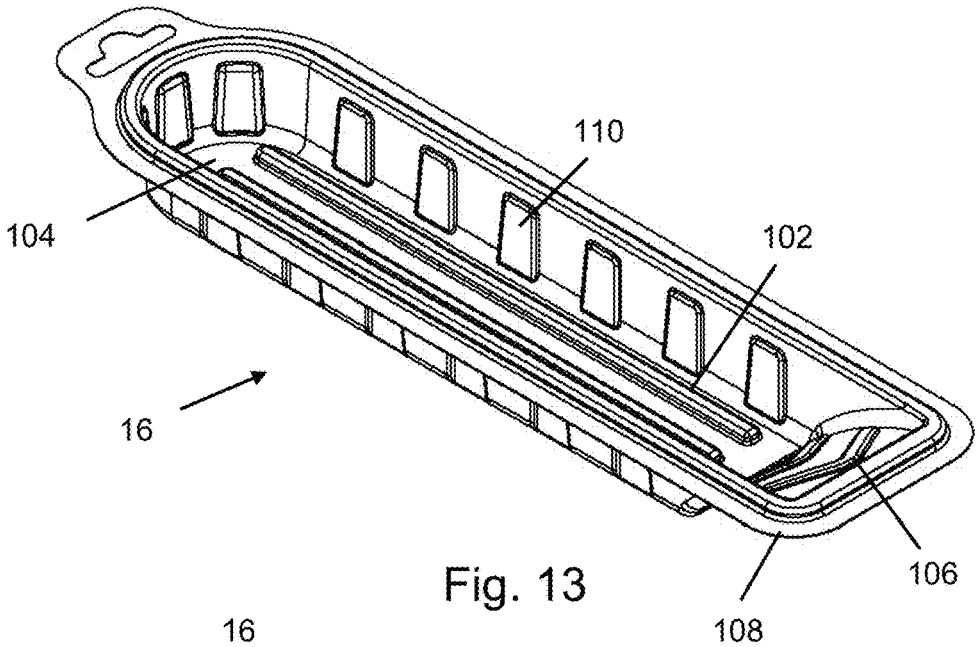
FIG. 13 is a perspective view of the paint tray of the painting system.
Figure 14:
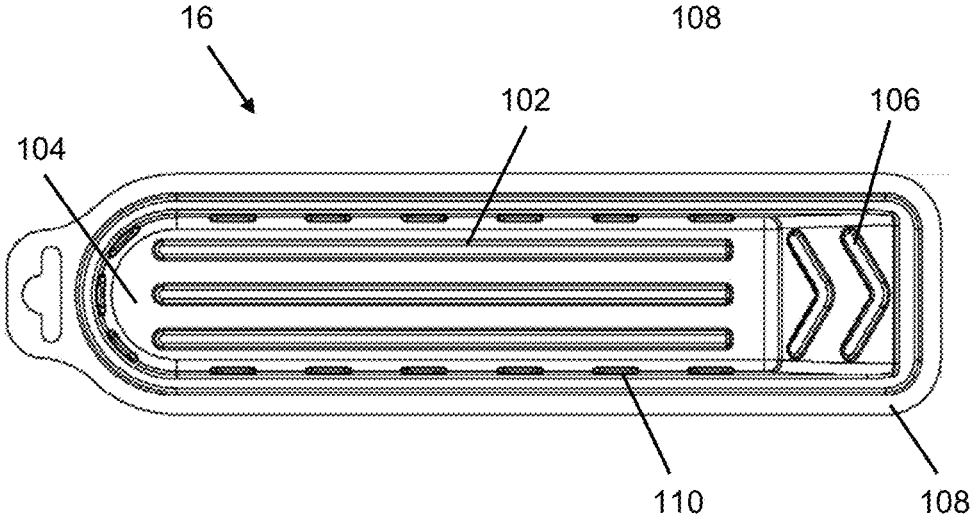
FIG. 14 is a top view of the paint tray of FIG. 13.
Figure 15:
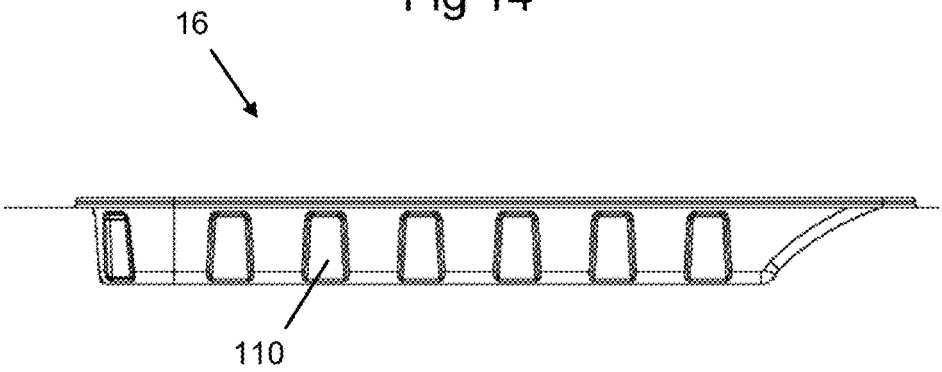
FIG. 15 is a side view of the paint tray of FIG. 13.

The paint tray 16 such as illustrated in FIGS. 13-15 is adapted to receive paint that is to be used when painting with the paint applicator 12. Since the amount of surface 101 that is behind a toilet bowl 100 is typically relatively small, the paint tray 16 does not need to hold a large amount of paint. The paint tray 16 may be formed with a length and a width that are slightly larger than the paint applicator 12.

A lower surface 104 of the paint tray 16 may be substantially flat to facilitate placing the paint tray 16 on a flat surface. The paint tray 16 may have at least one ridge 102 in the lower surface 104 thereof that supports the paint applicator 12 about the lower surface 104. In certain embodiments, there are several ridges 102 in the lower surface 104 that are provided in a spaced-apart configuration.

In one such embodiment, the ridges 102 are positioned proximate the side walls of the paint tray 16 and extend substantially between the front and back walls of the paint tray 16. The ridges 102 thereby longitudinally and latitudinally support the paint applicator 12 above the lower surface 104 to thereby limit the amount of paint that enters the paint applicator 12. The ridges 102 also facilitate flowing of paint along the lower surface 104 so that the level of the paint can be substantially the same throughout the paint tray 16. This feature facilitates a substantially similar amount of paint over the surface of the paint applicator 12.

The ridges 102 thereby provide the paint applicator holder 14 with stable support to minimize the potential of the paint applicator holder 14 inadvertently moving in the paint tray 16, as such movement could cause paint to spill out of the paint tray 16 and/or could cause the paint tray 16 to tip over.

The proximal end of the paint tray 16 may be oriented at an angle to facilitate scraping a portion of the paint from the paint applicator 12. The paint tray 16 may have at least one ridge 106 proximate a proximal end 108 thereof that can be used to scrape off a portion of paint from the paint applicator 12. In certain embodiments, there are two ridges 106 in a spaced-apart configuration and each of the ridges 106 have a chevron shape.

Sides of the paint tray 16 may have a plurality of ridges 110 formed therein to increase the strength of the paint tray 16. The number of ridges 110 may be determined by factors such as the material from which the paint tray 16 is formed.

Figure 1:
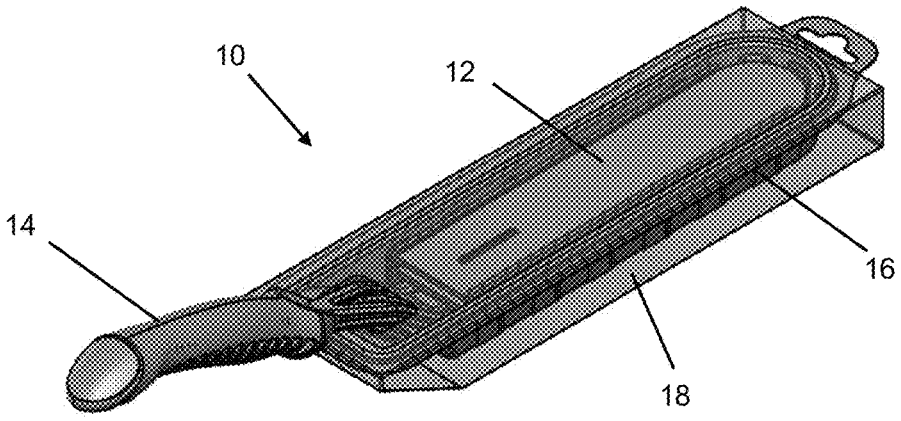
FIG. 1 is a perspective view of the painting system where an outer cover is transparent.
Figure 2:
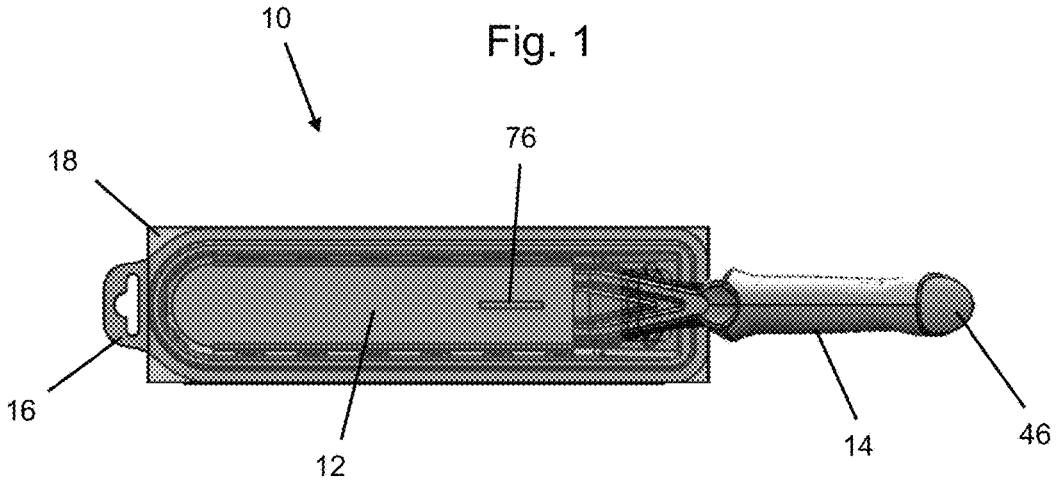
FIG. 2 is a top view of the painting system of FIG. 1.
Figure 3:
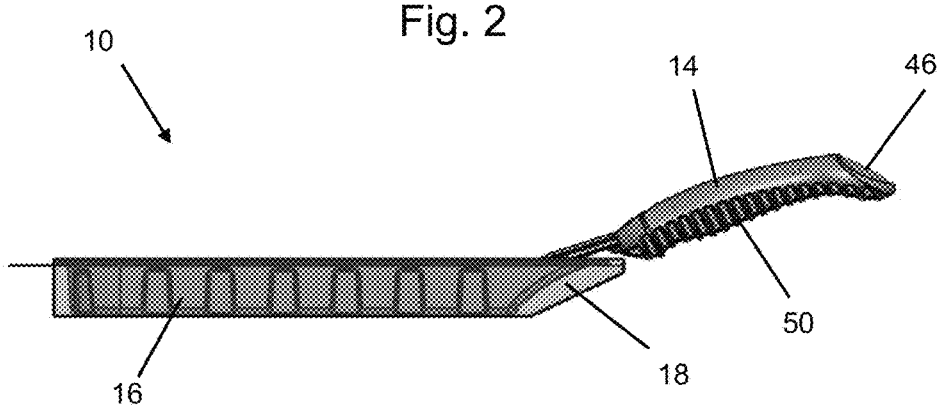
FIG. 3 is a side view of the painting system of FIG. 1.
Figure 4:
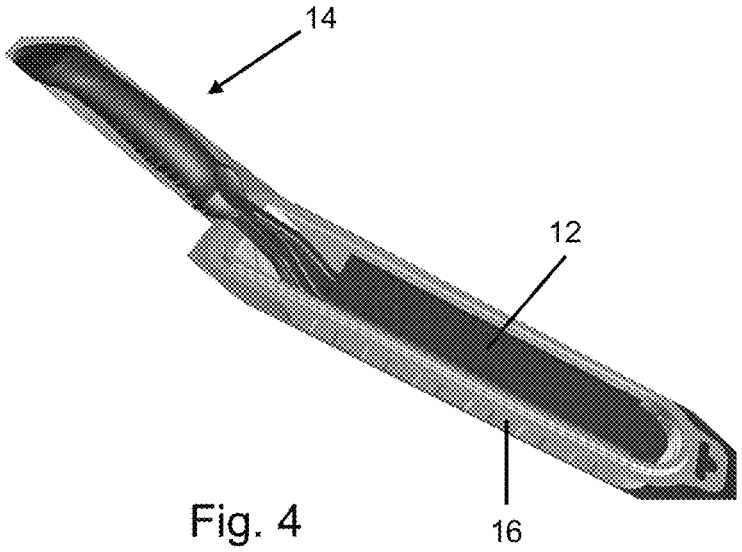
FIG. 4 is a perspective view the painting system with an outer cover removed.
Figure 5:
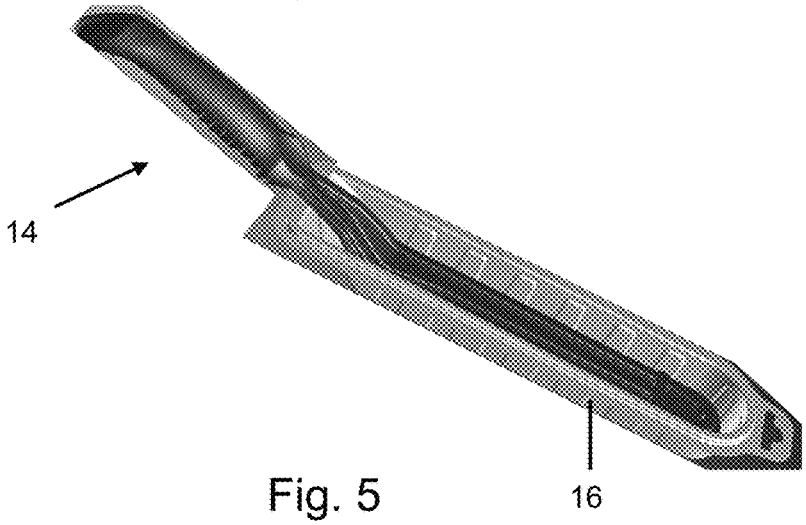
FIG. 5 is a perspective view of the painting system with the outer cover and the paint applicator removed.

The outer cover 18 covers at least a portion of the paint applicator 12, the paint applicator holder 14 and the paint tray 16, as illustrated in FIGS. 1-3. The outer cover 18 thereby retains the components together during distribution prior to sale to the consumer. The outer cover 18 may have a generally rectangular shape that is similar to the shape of the paint tray 16. In certain embodiments, the outer cover 18 does not cover the handle portion 20. The outer cover 18 may be fabricated from a variety of materials using the concepts of the invention. In certain embodiments, the outer cover 18 is fabricated from cardboard.

FIG. 16 illustrates the use of the painting system 10 in conjunction with applying paint to a wall surface 101 that is located behind an object 100 such as a toilet, which is located relatively close to the wall surface 101 such as to make it not possible to paint the wall surface 101 behind the object 100 using a conventional paint brush or a paint roller.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A painting system comprising:

a paint applicator having an elongated configuration with a length that is substantially greater than a width and a width that is substantially greater than a height, wherein the paint applicator has a generally planar shape;

a handle portion having a distal end; and an applicator portion extending from the distal end of the handle portion, wherein the paint applicator is removably attachable to the applicator portion, wherein an engagement structure that extends from one of the applicator portion and the paint applicator, wherein the engagement structure has a linear shape, wherein a recess is formed in the one of the applicator portion and the paint applicator from which the engagement structure does not extend, wherein the recess is adapted to receive a portion of the engagement structure to restrict movement of the paint applicator with respect to the applicator portion.

2. The painting system of claim 1, wherein at least a part of the applicator portion has a convex shape.

3. The painting system of claim 1, wherein the applicator portion has an upper surface and a lower surface and wherein the applicator portion has at least one reinforcing ridge extending from at least one of the upper surface and the lower surface.

4. The painting system of claim 3, wherein the at least one reinforcing ridge has an increased width section.

5. The painting system of claim 1, wherein the applicator portion has a stop mechanism extending from a surface thereof that engages the paint applicator when the paint applicator is attached to the applicator portion to prevent over-insertion of the paint applicator onto the applicator portion.

6. The painting system of claim 5, wherein the stop mechanism does not extend beyond an outer surface of the paint applicator when the paint applicator is attached to the applicator portion.

7. The painting system of claim 1, wherein the engagement structure is oriented generally parallel to a length of the applicator portion and wherein the engagement structure permits the paint applicator to be moved with respect to the applicator portion when a larger than threshold force is applied to at least one of the applicator portion and the paint applicator.

8. A painting system comprising:

a handle portion having a distal end;

an applicator portion extending from the distal end of the handle portion, wherein the applicator portion has a convex shape in a direction extending from a proximal end to a distal end thereof; and a paint applicator that is attachable to the applicator portion, wherein the paint applicator has an applicator pad that is capable of receiving paint, wherein the paint applicator has an elongated configuration with a length that is substantially greater than a width and a width that is substantially greater than a height and wherein the paint applicator has a generally planar shape.

9. The painting system of claim 8, wherein the applicator portion has an upper surface and a lower surface and wherein the applicator portion has at least one reinforcing ridge extending from at least one of the upper surface and the lower surface.

10. The painting system of claim 8, wherein the paint applicator has an elongated configuration with a length that is substantially greater than a width and a width that is substantially greater than a height, wherein the paint applicator has a generally planar shape and wherein the handle portion extends from an end of the paint applicator that corresponds to the width of the paint applicator.

11. The painting system of claim 8, wherein an engagement structure that extends from one of the applicator portion and the paint applicator, wherein a recess is formed in the one of the applicator portion and the paint applicator from which the engagement structure does not extend, wherein the recess is adapted to receive a portion of the engagement structure to restrict movement of the paint applicator with respect to the applicator portion.

12. The painting system of claim 11, wherein the engagement structure has a linear shape that is oriented generally parallel to a length of the applicator portion and wherein the engagement structure permits the paint applicator to be moved with respect to the applicator portion when a larger than threshold force is applied to at least one of the applicator portion and the paint applicator.

13. The painting system of claim 8, wherein the applicator portion has a stop mechanism extending from a surface thereof that engages the paint applicator when the paint applicator is attached to the applicator portion to prevent over-insertion of the paint applicator onto the applicator portion and wherein the stop mechanism does not extend beyond an outer surface of the paint applicator when the paint applicator is attached to the applicator portion.

14. A painting system comprising:

a paint applicator having an elongated configuration with a length that is substantially greater than a width and a width that is substantially greater than a height, wherein the paint applicator has a generally planar shape;

a handle portion having a distal end; and an applicator portion extending from the distal end of the handle portion, wherein the paint applicator is removably attachable to the applicator portion, wherein an engagement structure that extends from one of the applicator portion and the paint applicator, wherein a recess is formed in the one of the applicator portion and the paint applicator from which the engagement structure does not extend, wherein the recess is adapted to receive a portion of the engagement structure to restrict movement of the paint applicator with respect to the applicator portion, wherein the applicator portion has an upper surface and a lower surface and wherein the applicator portion has at least one reinforcing ridge extending from at least one of the upper surface and the lower surface.

15. The painting system of claim 14, wherein the at least one reinforcing ridge has an increased width section.

16. The painting system of claim 14, wherein an engagement structure that extends from one of the applicator portion and the paint applicator, wherein a recess is formed in the one of the applicator portion and the paint applicator from which the engagement structure does not extend, wherein the recess is adapted to receive a portion of the engagement structure to restrict movement of the paint applicator with respect to the applicator portion.

17. The painting system of claim 16, wherein the engagement structure has a linear shape that is oriented generally parallel to a length of the applicator portion and wherein the engagement structure permits the paint applicator to be moved with respect to the applicator portion when a larger than threshold force is applied to at least one of the applicator portion and the paint applicator.

18. The painting system of claim 14, wherein the applicator portion has a convex shape in a direction extending from a proximal end to a distal end thereof.

* * * * *